United States Patent [19]

Hoffmann

[11] Patent Number: 4,470,604

[45] Date of Patent: Sep. 11, 1984

[54] TARGET PRACTICE SYSTEM

[76] Inventor: Anton R. Hoffmann, 821 E. Northmoor Rd., Lake Forest, Ill. 60045

[21] Appl. No.: 859,720

[22] Filed: Dec. 12, 1977

[51] Int. Cl.[3] ..... A63B 63/00; F42B 9/20

[52] U.S. Cl. ..... 273/404; 102/529; 273/410

[58] Field of Search ..... 102/92.7, 41, 529, 444; 273/102.4, 404, 410

[56] References Cited

U.S. PATENT DOCUMENTS

| | | | |
|---|---|---|---|
| 1,602,441 | 12/1926 | Mallery | 273/404 |
| 1,861,522 | 6/1932 | Brandt | 102/93 |
| 3,157,126 | 11/1964 | Blondeau | 102/92.1 |
| 3,203,698 | 8/1965 | Saunders | 273/102.4 |
| 3,334,587 | 8/1967 | Stadler et al. | 102/41 |
| 3,495,829 | 2/1970 | Booth | 273/102.4 X |
| 3,724,377 | 4/1973 | Birkigt | 102/38 R A |
| 3,737,165 | 6/1973 | Pencyla | 273/102.4 |
| 3,786,760 | 1/1974 | Feldmann | 102/93 |

FOREIGN PATENT DOCUMENTS

| | | | |
|---|---|---|---|
| 302184 | 10/1954 | Switzerland | 102/41 |

*Primary Examiner*—Harold J. Tudor

*Attorney, Agent, or Firm*—O'Neill & Bockelman

[57] ABSTRACT

A target practice system including reusable cartridges for firearms and a bullet trap for stopping the flight of projectiles from the cartridges. The case of the cartridge is adapted to receive the projectile, or alternative standard cases may be used. The projectile has a cylindrical core of a diameter less than the rifling of the firearm and axially spaced-apart, outwardly opening channels extend circumferentially about the core. Endless resilient rings are inserted into the channels. A powder-receiving hole is provided in the rearward end of the projectile. When fired, the projectile rides on the resilient rings as it travels down the barrel of the firearm. The core does not come in contact with the barrel, and the resilient rings center the core in the barrel during travel down it for improved accuracy. A rocket-like effect is realized from the rearward discharge of gases liberated by combustion. Also, methods of loading the reusable cartridges are disclosed.

4 Claims, 12 Drawing Figures

FIG. 1
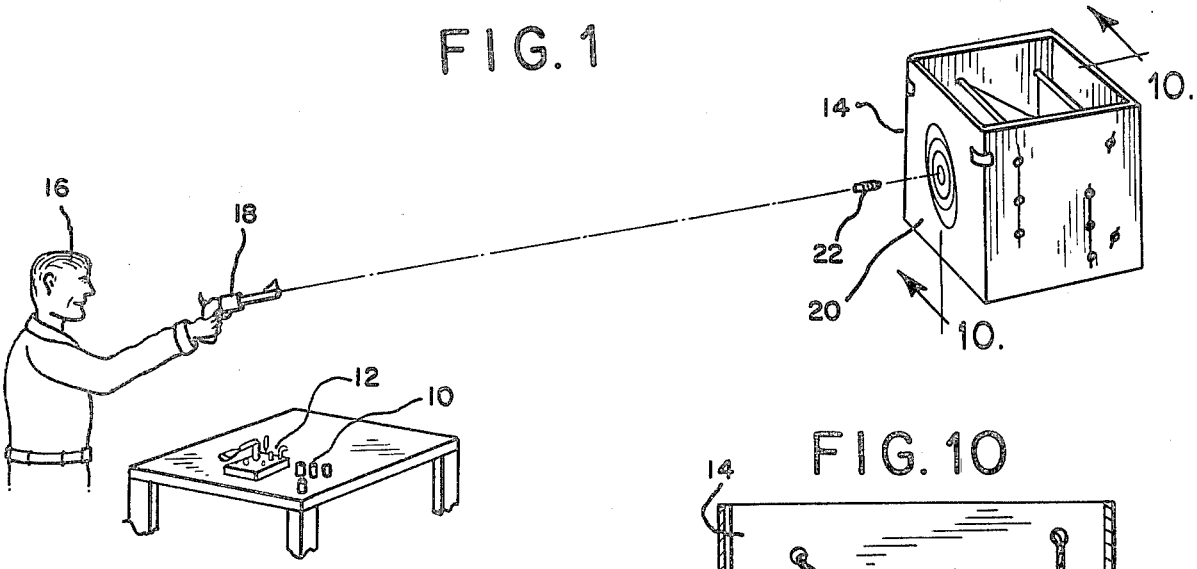
FIG. 10
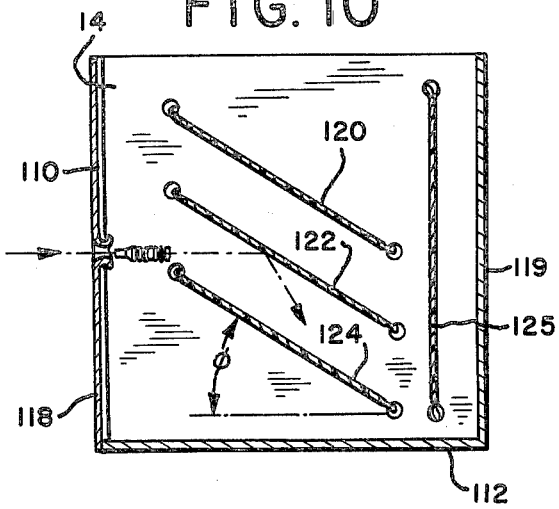
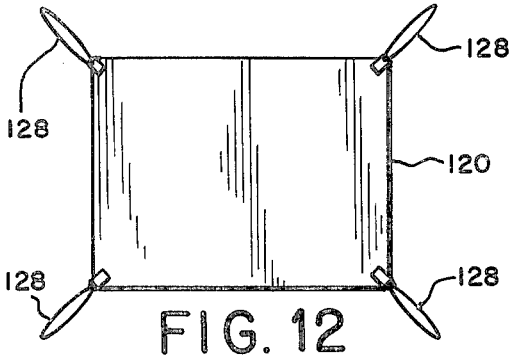
FIG. 12
FIG. 11
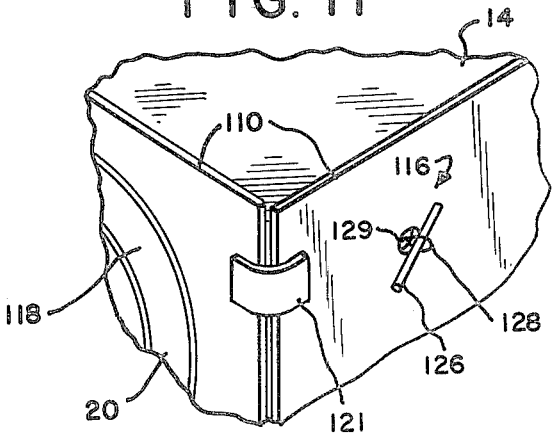
FIG. 2
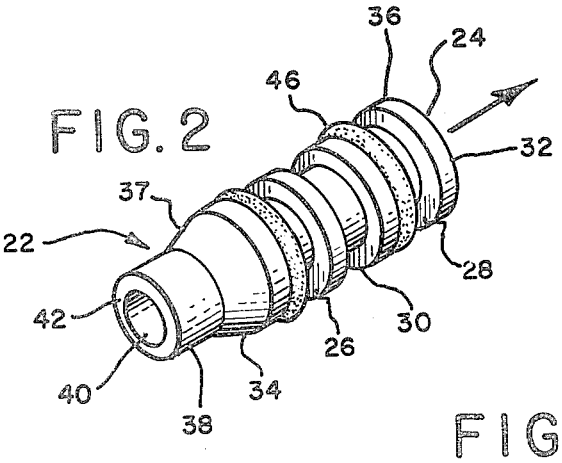
FIG. 3
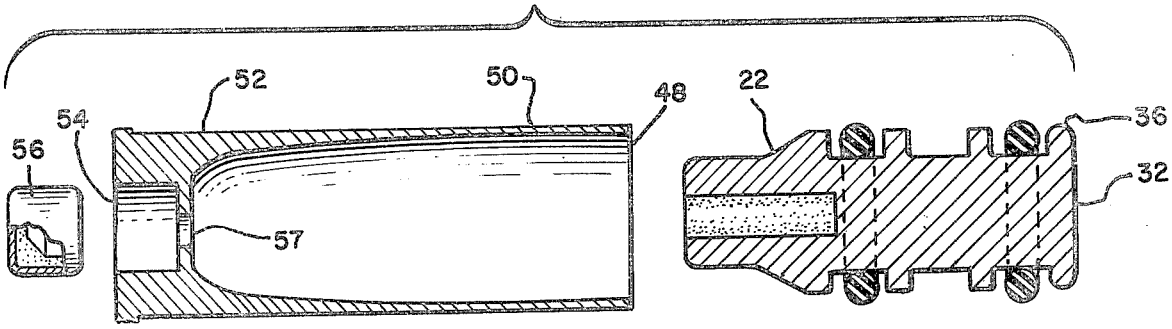

FIG. 4
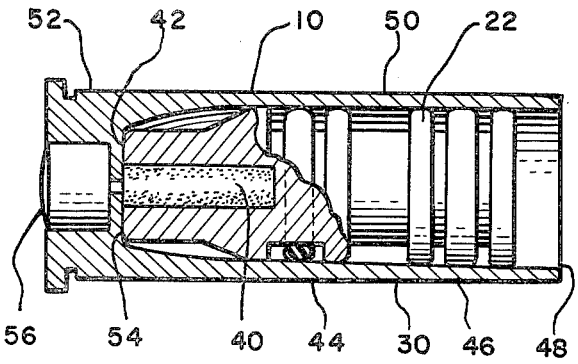
FIG. 5
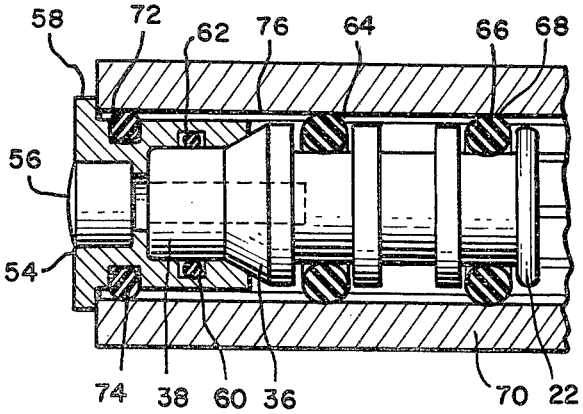
FIG. 6
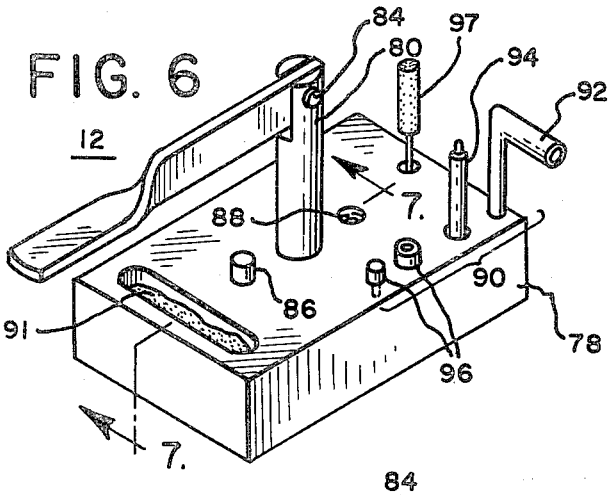
FIG. 8
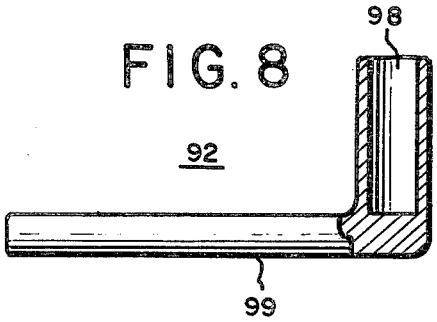
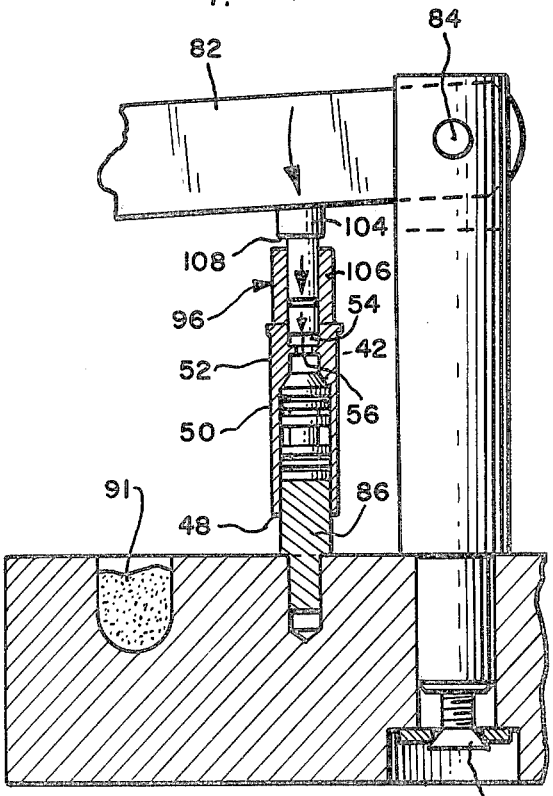
FIG. 7
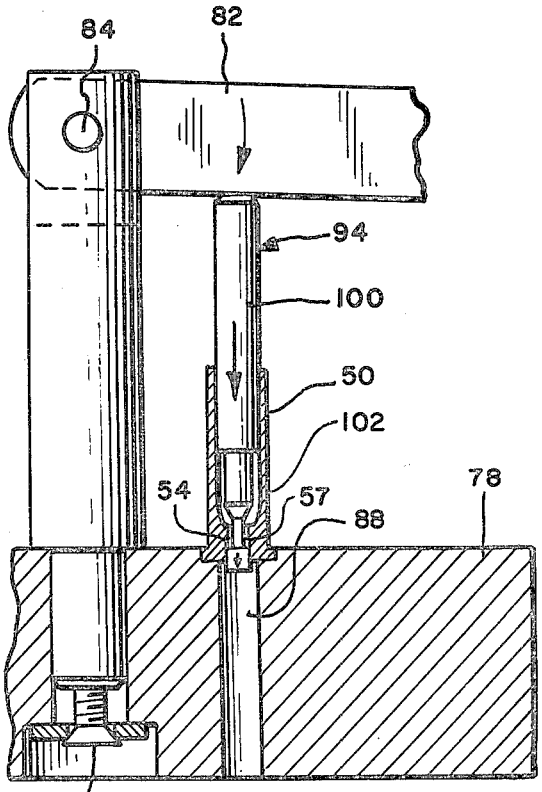
FIG. 9

TARGET PRACTICE SYSTEM

BACKGROUND OF THE INVENTION

This invention relates to target practice systems for firearms and, more particularly, to projectiles, bullet traps and methods of reloading cartridges.

Home target practice systems are becoming increasingly popular. To be successful, the system must be relatively inexpensive, and the projectiles must accurately follow the marksman's aim and be reusable.

Reusable bullets or projectiles known to the prior art are not satisfactory, and become deformed after repeated use. When fired, deformed projectiles contribute to aiming inaccuracies. Plastic and wax bullets require large primers and special cases and do not accurately follow the marksman's aim. Moreover, these bullets often "keyhole" the target and do not always punch a clean hole.

Bullet traps known to the prior art are often undesirable for home use. Usually they are made of steel and are therefore heavy and expensive. Noise may be objectionable to neighbors, and the marksman should wear earmuffs. Moreover, impact of the bullet often destroys it, requiring that it be melted and recast. This requires additional expensive equipment.

The cost of home target practice systems may be substantially reduced if the marksman is able to easily reload his own cases using his own reusable projectiles. However, current reloading techniques and methods are time-consuming, and require a certain amount of skill for proper reloading.

SUMMARY OF THE INVENTION

In accordance with the present invention, I have developed a target practice system which overcomes each of the disadvantages recited above and includes reusable projectiles which may be used with standard cases and primers.

A reusable projectile has a core with spaced-apart channels extending around its circumference. An opening in the rearward end of the projectile receives powder or propellant. Resilient rings are disposed within the channels on which the projectile rides during propulsion through the bore of the firearm. The projectile is centered in the barrel by the resilient rings. When fired, the projectile is propelled down the barrel of the firearm with a rocket-like effect resulting from the rearward discharge of gases liberated by combustion. The resilient rings are slightly compressed, centering the projectile in the bore. The projectile acquires spin imparted by the rifling so that the projectile accurately follows the aim of the marksman.

Bullet travel is terminated by a trap having several deflection sheets suspended from flexible members. The trap minimizes core deformation, thereby increasing the life of the projectile and minimizing excessive tearing of the target.

It is a feature of the present invention to provide a projectile which conforms to the rifling of a firearm so that the projectile accurately follows the aim of the marksman.

Another feature is to provide a target practice system which includes a projectile, a method of reloading a bullet formed with the projectile, and a bullet trap.

A further feature is to provide a projectile which may be reused many times with a standard bullet case.

Yet another feature is to provide a relatively nonlethal projectile which accurately follows the aim of the marksman even if its core becomes slightly deformed.

DRAWING

FIG. 1 is a perspective view of the target practice system in accordance with the present invention;

FIG. 2 is a perspective view of the projectile shown in FIG. 1;

FIG. 3 is an exploded cross-sectional view of a projectile in accordance with the present invention, and a standard case;

FIG. 4 is a view of the assembled projectile and standard case with the case shown in cross section and the projectile shown partially in cross section;

FIG. 5 is a view of another bullet in the rifling of a firearm with the special primer holder broken away and the projectile partially in cross section;

FIG. 6 is a perspective view of the inexpensive bullet reloader shown in FIG. 1;

FIG. 7 is a cross-sectional view of the bullet reloader shown in FIG. 6;

FIG. 8 is a view of a powder measuring tool for measuring powder shown partially in section;

FIG. 9 is yet another cross-sectional view of the bullet reloader;

FIG. 10 is a cross-sectional view of the bullet trap shown in FIG. 1;

FIG. 11 is a perspective view of a portion of the bullet trap shown in FIG. 1; and FIG. 12 is a view of a typical deflection sheet used in the bullet trap.

DESCRIPTION OF THE PREFERRED EMBODIMENTS

Referring to FIG. 1, the target practice system includes cartridges 10, bullet reloader 12 and bullet trap 14. Marksman 16, holding a firearm 18 of a selected caliber, is positioned twenty-five to seventy-five feet in front of target 20, which is mounted on bullet trap 14. As shown, projectile 22 is accurately following the aim of marksman 16. Generally, several bullets are fired from firearm 18. Then target 20 is scored in the well-known manner.

Referring to FIG. 2, projectile 22 includes a cylindrical core 24 having a diameter less than the inside diameter of the rifling of the selected firearm 18. The core may be machined or die cast from almost any material including, for example, aluminum or a hard alloy. Two outwardly opening U-shaped channels 26 and 28, respectively, extend circumferentially about core 24. Channels 26 and 28 are spaced apart, preferably by a distance equal to or greater than the diameter of the bore of firearm 18. Recess 30 extends along the axis of core 24 from channel 26 to channel 28. Recess 30 permits the core 24 to be of lighter weight and could accommodate another ring.

Core 24 has a forward end 32 and a rearward end 34. A radius 36 may be provided along the edge of the forward end 32 to minimize tearing of bullet trap 14 during shooting. End 34 is formed by a truncated cone 37 which tapers rearwardly, from which extends a cylindrical tail section 38.

The cylindrical tail section 38 has a powder-receiving hole 40, the center of which extends along the axis of core 24. The depth and diameter of hole 40 is selected to receive a measured amount of powder or propellant, as will be explained in detail below. Annular ridge 42 is located between hole 40 and the outer surface of cylindrical tail section 38.

Channels 26 and 28 are provided with endless resilient rings 44 and 46, respectively. The resilient rings may be O-rings or, alternatively, may be integrally formed with core 24. Preferably, the material is rubber, either synthetic or natural, or a plastic having resilient properties so that it can easily conform to the rifling of the firearm when fired. The width of rings 44 and 46 may be somewhat less than the width of the channels 26 and 28.

As shown in FIG. 3, the projectile 22 is inserted through mouth 48 of case 50. The case 50 may be of standard construction generally made of brass so that it may be reused. The case has a base 52 with a primer pocket 54 in which replaceable primer 56 is inserted. Flashhole 57 extends between primer pocket 54 and the inside of case 50. The construction of primer 56 and case 50 forms no part of the present invention.

Referring to FIG. 4, the projectile 22 is disposed within case 50 so that annular ridge 42 is in abutment with the base 52. Powder or propellant fills hole 40, and rings 44 and 46 are compressed, retaining the projectile 22 within case 50, thereby forming cartridge 10.

Referring to FIG. 5, an alternative configuration of cartridge 10 is shown. This configuration obviates the need for the chamber and the forcing cone in the firearm for improved accuracy. Specifically, a special primer holder 58 is adapted to receive the cylindrical tail section 38 and the truncated cone 36 of projectile 22. The holder 58 is similar to case 50 in that it is provided with primer pocket 54 which receives primer 56. The projectile 22 is retained within holder 58 by an O-ring 60 or other suitable elastomeric material seated within inwardly opening channel 62. Also, resilient rings 64 and 66, which may be O-rings or integrally-formed rings, are located within channels 26 and 28, respectively. The diameter of the projectile 22 taken across the rings 64 and 66 is greater than the inside diameter of the bore 68 of the firearm 70 when the rings are not deformed.

Primer holder 58 may be provided with an outwardly opening channel 72 which receives an O-ring 74 to seal the rifling 76 of bore 68. Thus, when the projectile 22 is propelled down the rifled barrel, the rings 64 and 66 conform to it, sealing gases and imparting spin and stability to projectile 22. Of course, O-ring 60 need not be used if other sealing means is used to keep the projectile 22 and the holder 58 together. Often, O-rings 74 may be eliminated, as well. Moreover, neither O-ring 60 nor O-ring 74 need be perfectly round.

The amount of powder or propellant in hole 40 determines the velocity of projectile 22. Accordingly, the volume of hole 40 is determined for a desired speed and a selected powder. When fired, primer 56 ignites the powder, causing a rearward discharge of gases from hole 40, propelling projectile 22 forward.

Referring to FIG. 6, the bullet reloader 12 includes a base 78 to which a vertically extending center post 80 is attached by screw 81 (FIG. 7). Arm 82 is mounted for rotation about post 80 at pin 84. The arm 82 may be rotated slightly greater than 180°.

On one side of post 80, directly below arm 82, a pedestal 86 extends upwardly for receiving projectile 22 within case 50. The height of pedestal 86 is sufficient to preclude mouth 48 of case 50 from abutting the surface of base 78 as shown in FIG. 7. Pedestal 86, therefore, permits annular ridge 42 of projectile 22 to abut head 52 of case 50. The purpose for this relationship will be explained below.

Base 78 is provided with a receptacle 88 of a lesser diameter than the diameter of case 50 on the side opposite pedestal 86. Receptacle 88 is directly below arm 82 when rotated 180° from the position shown in FIG. 6.

Also, the base 78 is provided with a plurality of sockets which receive reloading tools 90, and a powder trough 91 may be provided in base 78 for gun powder.

Tools 90 include powder measurer tool 92, primer punch 94, a primer seating device 96, and case mop 97, all of which are employed during the reloading of cartridge 10. Powder measurer tool 92 has a cavity 98 of a volume substantially equal to the volume of hole 40, as best seen in FIG. 8, and a handle 99. Primer punch 94, as best seen in FIG. 9, includes a dowel 100 of sufficient length to extend within case 50. The dowel 100 has a point 102 of a reduced diameter to extend through primer pocket 54 and flashhole 57. The primer seating device 96 includes a plunger 104 and a hollow cylinder 106, as best seen in FIG. 7. The inside diameter of hollow cylinder 106 is sufficiently large to accommodate primer 56. The plunger 104 has a shoulder 108 which abuts hollow cylinder 106 to properly seat primer 56 within primer pocket 54 when cartridge 10 is resting on pedestal 86 during loading. Case mop 97 may be used for cleaning out the powder residue from case 50.

The bullet may be loaded by two separate methods. In one method, powder may be poured into hole 40 of projectile 22, keeping the tail of the projectile in an upright position. The powder is leveled off at the top and projectile 22 is then inserted into case 50. As seen in FIG. 7, pedestal 86 urges projectile 22 upwardly so that annular ridge 42 abuts base 52 as the case 50 is pushed downwardly. Thereafter, primer 56 may be seated within primer pocket 54 by the use of the primer seating device 96. Specifically, as arm 82 is rotated toward base 78, plunger 104 urges primer 56 into primer pocket 54. The primer 56 is properly fitted within the primer pocket 54 when shoulder 108 meets hollow cylinder 106. It should be noted that very little air becomes trapped between the primer and the projectile, thus assuring a more even burn during firing.

The expired primer may be removed from case 50 by the use of primer punch 94, as seen in FIG. 9. When arm 82 urges dowel 100 downwardly, pin 102 forces primer 56 out of primer pocket 54 and into receptacle 88.

An alternate method of loading may be provided wherein the projectile 22 is first inserted within case 50 and mounted on pedestal 86 so that annular ridge 42 abuts seat 52. Thereafter, powder means 92 may be dipped into the powder in trough 91 so that cavity 98 is filled. The powder from measurer 92 may then be poured through primer pocket 54 and flashhole 57 and into hole 40 of projectile 22. Then primer seating device 96 may be employed with arm 82 to seat the primer 56 within primer pocket 54 as described above.

It should be noted that during conventional reloading known to the prior art, the primer is first inserted into the primer pocket. Then, with the base of the case down, a measured amount of powder is dropped into the mouth of the case. Thereafter, the bullet is forced into the mouth of the case to a measured depth. In most cartridges there may be a considerable amount of air compressed in this space. The compressed air may or may not eventually leak out, and can cause variable expansion rate of the gases and consequently variable velocity of the bullet. The loading methods of the present invention are reversed when compared to conventional reloading methods.

Referring to FIGS. 10 and 11, bullet trap 14 includes flaps 110, a bottom 112, two spaced-apart sides 116 of identical construction, face 118 and rear 119. The bullet trap may be of cardboard and used for shipping the home target practice system. Target 20 is mounted on face 118. Flaps 110 are opened upwardly and retained by tape 121. Flaps 110 form a portion of the sides 116, face 118, and rear 119. Vertically spaced deflection sheets 120, 122 and 124 are mounted within bullet trap 14 at an acute angle $\phi$. A vertically disposed deflection sheet 125 is suspended parallel to rear 119. The deflection sheets are retained by dowels 126 on sides 116. Flexible members 128 extend through hole 129 and capture dowels 126. As best seen in FIG. 12, deflection sheet 120, which is characteristic of the remaining sheets, has an elastomeric flexible member 128 secured to each corner. The deflection sheet 120 may be of any suitable fabric including neoprene coated with nylon.

Although the above-described projectile is particularly suited for firearms of small caliber, as 0.22, 0.38 and 0.44, the principles of this invention, including the methods of loading cartridges, apply to even larger caliber firearms.

I claim:

1. In a projectile adapted to be received in a case, wherein the projectile and the case are suitable for reuse in a firearm of a specified caliber, an improved projectile comprising:

a cylindrical core having a forward and rearward end and a diameter less than the inside diameter of the rifling of the firearm, wherein the cylindrical core tapers rearwardly, forming a truncated cone from which a cylindrical tail section extends;

a powder receiving opening located in said rearward end;

first outwardly opening channel means extending circumferentially about said core;

second outwardly opening channel means extending circumferentially about said core;

endless resilient ring means disposed in said channel means, the thickness of the ring means selected so that the ring means is greater than the inside diamter of the rifling of the firearm.

2. The projectile of claim 1 wherein said opening extends along the axis of the core and is located in said cylindrical tail section.

3. A target practice system for a firearm of a selected caliber including:

a reusable cartridge for said firearm including:

a projectile having a cylindrical core of a diameter less than the rifling of the firearm;

outwardly opening channel means extending circumferentially about the core; and endless resilient ring means disposed in said channel wherein the diameter of the projectile at the resilient ring means is greater than the diameter of the rifling of the firearm; and a case adapted to receive the projectile; and projectile trap means for stopping the flight of the projectile when said projectile strikes said trap means including a receptacle having an open face, two spaced-apart sides, a bottom and a back;

a pierceable target mounted across the face of the receptacle;

a plurality of vertically spaced-apart deflection sheets; and resilient connecting means attached to each sheet and to the sides of the receptacle for suspending the sheets from the sides so that each sheet angles downwardly toward said back wherein said resilient connecting means includes a plurality of flexible members each having one end attached to a separate corner of a sheet and an opposite end extending through the side of the receptacle adjacent to the corner, and means attached to the opposite end of each member for coupling each member to said side.

4. The system of claim 3 wherein the opposite end of each member is formed as a loop and said means attached to the opposite end of each member is a dowel extending through the loop.

* * * * *